US006644442B1

(12) United States Patent
Ylinen et al.

(10) Patent No.: US 6,644,442 B1
(45) Date of Patent: Nov. 11, 2003

(54) METHOD FOR IMMEDIATE ALLOCATION OF LANDING CALLS

(75) Inventors: Jari Ylinen, Hyvinkaa (FI); Tapio Tyni, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/232,365

(22) Filed: Sep. 3, 2002

Related U.S. Application Data

(63) Continuation of application No. PCT/FI01/00218, filed on Mar. 5, 2001.

(51) Int. Cl.[7] ..... B66B 1/18
(52) U.S. Cl. ..... 187/382; 187/391
(58) Field of Search ..... 187/380, 382, 187/385, 386, 387, 388, 389, 397, 399, 391, 394

(56) References Cited

U.S. PATENT DOCUMENTS 4,263,989 A * 4/1981 Zeindler et al. ..... 187/387
4,492,288 A * 1/1985 Schroder ..... 187/387
5,283,399 A * 2/1994 Fujino et al. ..... 187/382
5,672,853 A * 9/1997 Whitehall et al. ..... 187/380
5,907,137 A * 5/1999 Tyni et al. ..... 187/382
5,923,004 A * 7/1999 Whitehall et al. ..... 187/382
5,932,852 A * 8/1999 Tyni et al. ..... 187/382
6,000,504 A * 12/1999 Koh et al. ..... 187/382
6,293,368 B1 * 9/2001 Ylinen et al. ..... 187/382
2001/0010278 A1 * 8/2001 Hikita ..... 187/382

FOREIGN PATENT DOCUMENTS

EP 0 897 891 A1 2/1999
WO WO 96/33123 10/1996
WO WO 99/33741 7/1999

* cited by examiner

*Primary Examiner*—Jonathan Salata
(74) *Attorney, Agent, or Firm*—Birch, Stewart, Kolasch & Birch, LLP

(57) ABSTRACT

A method for allocating calls entered via the landing call devices of elevators belonging to an elevator group so that there are simultaneously at least one floor to be signaled according to the service routes of the elevators. The allocation decision is is made by a genetic allocation method. The allocation decision is input into a call fixation control unit, which takes care of the reservation and release of landing calls and the control of signaling. In the case of a reserved landing call, the range of values of the gene is limited.

5 Claims, 2 Drawing Sheets

METHOD FOR IMMEDIATE ALLOCATION OF LANDING CALLS

Figure 1:
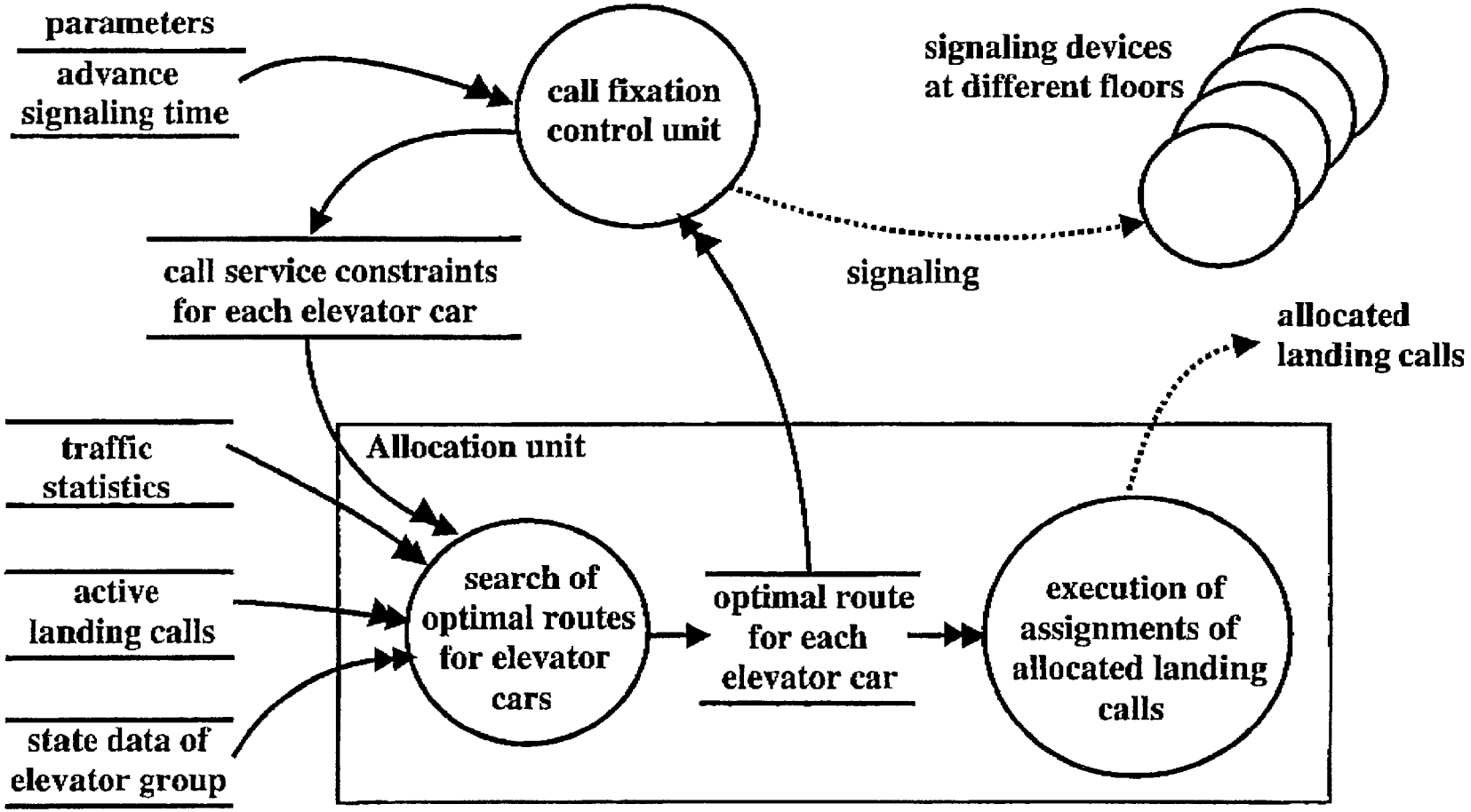

This application is a Continuation of copending PCT International Application No. PCT/FI01/00218 filed on Mar. 5, 2001, which designated the United States and on which priority is claimed under 35 U.S.C. §120, the entire contents of which are hereby incorporated by reference.

The present invention relates to a method for allocating calls given via landing call devices of elevators belonging to an elevator group so that all calls will be served.

When a passenger wants to have a ride on an elevator, he/she will issue a call for an elevator by pressing a landing call button mounted at the floor. The control system of the elevator group receives the call for an elevator and tries to figure out which one of the elevators in the elevator group will be best able to serve the call. The activity is termed call allocation. The problem to be solved by allocation is how to find the elevators to serve landing calls so as to minimize a preselected cost factor. Allocation may aim at minimizing passengers' waiting time, passengers' traveling time, the number of times the elevator will stop.

Traditionally, to establish which one of the elevators would be appropriate to serve a call, the reasoning is carried out individually for each case using complicated conditional structures. The final aim of this reasoning is to minimize a cost factor describing the operation of the elevator group, typically e.g. the call time or the average waiting time of the passengers. As the elevator group works in a complicated state space, the conditional structures are also complicated and they cannot cover all possible situations. Thus, there appear situations in which the control is not functioning in an optimal way. Likewise, it is difficult to take the elevator group into consideration as a whole. A typical example of this is the traditional collective control, in which a landing call is served by the one of the elevators which is traveling in the direction toward the call at the closest distance from the calling floor. This simple optimization principle, however, leads to aggregation of the elevators, which means that the elevators are traveling in a front in the same direction, and therefore to a fall in the performance of the elevator group as a whole.

An attempt to determine the cost factors for all possible route alternatives is likely to require a computing capacity exceeding the capacity of the existing processors. If the number of calls to be served is C and the building has L elevators, then the number of different route alternatives will be $N=L^c$. Since the number of route alternatives increases exponentially as the number of calls increases, it is impossible to systematically consider all route alternatives even in a small elevator group. This has been a limitation hampering the application of route optimization in practice. On a general level, allocation methods can be classified into at least three approaches when the matter is considered from the passengers' point of view: continuous, immediate and target-oriented allocation methods. In continuous allocation of landing calls, landing calls are allocated to an elevator car at an instant when the elevator assigned to a given landing call is still able to stop at the floor in question. Until that instant, the distribution of active landing calls among the elevator cars can be changed freely. Continuous allocation is typically used e.g. in Europe. However, for example in Asia, elevator systems are designed with the aim of allowing passengers to know immediately upon pressing a landing call which elevator is going to serve them. In this case, the landing calls issued are allocated immediately to the elevators that are to serve them. Once allocated, a call should not be switched to another elevator. Target-oriented allocation again is perceived by the passenger above all as a different user interface between the passenger and the elevator system, in which the passenger is informed individually via a separate interface as to which elevator is going to serve him/her. With the solution of the invention, the uncertainty as to the right elevator is reduced and passengers can walk tranquilly to the area in front of the elevator which is going to serve them. The control unit used is a unit controlling the fixation of calls. The solution of the invention also improves traveling comfort and indirectly also the performance of the system.

As for the features characteristic of the invention, reference is made to the claims.

In the solution of the invention, an allocation unit finds the best routes for the elevators, in other words, makes the actual decisions as to which one of the elevator cars is to serve each call. A landing call-specific allocation suggestion is transmitted to a call fixation control unit, which registers each landing call as being reserved for the elevator car suggested for it. The landing call data from the allocation unit includes data giving, in addition to the elevator, also an estimated time of arrival (ETA) at the floor of issue of the landing call. While registering the landing call as being reserved for the suggested elevator car, the call fixation control unit sends a signaling command to this elevator, which will immediately perform signaling at the floor in question. In pure immediate-allocation, a landing call is immediately fixed for the elevator car allocated to serve it, but in the proposed method it is also possible to control the instant of fixation so that fixation will take place in a completely stepless manner. In this case, a parameter is used which determines how many seconds before the arrival of the elevator the landing call is to be fixed for the elevator car and signaled to passengers. Another alternative is to define the time in seconds after the entry of a landing call within which the call is to be reserved for an elevator car and signaled to passengers. By comparing the time of this parameter in the former case to the ETA time, the system decides whether the landing call is to be reserved for an elevator car or whether it shall be kept free to be allocated to any car in the elevator group. In the latter case, the parameter is compared with the length of time the landing call has been active. The value of both parameters can be varied e.g. according to traffic intensity and/or traffic type or according to time and date or a preliminary plan.

In case of special situations, the call fixation control unit must also be able to release one or more landing calls already reserved so as to allow the call(s) to be served by any other elevator car. Such situations include cases where an elevator is separated from the elevator group e.g. because of a technical failure, cases of activation of locking of an elevator, cases of an elevator car being loaded to full capacity and consequent possible bypassing of landing calls, cases of landing calls remaining active for an excessively long time, situations illogical from the point of view of the passengers, such as when an elevator (serving a car call) arrives at the floor of a landing call but then goes on traveling in the opposite direction relative to the passenger's destination. When a landing call has to be released for one reason or another, the call fixation control unit makes an entry in its bookkeeping system to the effect that the landing call may be served by any one of the elevators (not necessarily the one which had been intended for it before). In this case, the control unit also sends to the elevator a signaling command concerning the landing call that will turn off the signal lights.

The action is based on limiting the search range of a route finding algorithm in the allocation unit. A control decision alternative or chromosome contains landing call-specific genes whose value indicates the elevator car that is to serve the landing call in question. Thus, the range of values of each individual gene is the same as the number of possible elevator cars that are able to serve the call. If the elevator group has e.g. eight elevators which are all able to serve the call, then the range of values for the gene will be eight. At the start of a search for a control decision, the allocation unit sends to the call fixation control unit an inquiry for each landing call, asking which elevator cars are able to serve the landing call in question. If the landing call is still free (unallocated), all cars can serve it and the final range of values for the landing call will equal the number of elevator cars, assuming that there are no other limitations, such as locked states. By contrast, if the call fixation control unit has reserved the landing call for one of the elevator cars, then the range of values for the gene will be one, and the only possible value will be the elevator car for which the call has been reserved. In practice, therefore, the reservation of the landing call limits the range of values of the gene to one possible value, so when an allocation decision is made, the landing call will always end up being allocated to the elevator car for which it has been reserved. If the landing call is free, e.g. one that has just appeared in the elevator system or that has been released because of a special situation, the allocation procedure will perform a search according to its own principles to find an optimal elevator car for the call and all other free landing calls. After a final control decision has been made, it is transmitted to the call fixation control unit, which will reserve the free landing calls for elevator cars according to the control decision.

The immediate landing call allocation method differs essentially from continuous allocation in that, instead of a single floor, there may be several floors to be signaled at the same time according to the service routes of the elevator cars.

The call fixation control unit takes care of reservation and release of landing calls as well as the commands for corresponding signaling. Reservation of landing calls means that the calls may only be served by a single car, and release of calls means that the landing calls may be served by any one of the elevators. An actual allocation decision is made by a genetic allocation method by limiting the range of values of landing call-specific genes in accordance with the status of call reservation, which is obtained from the call fixation control unit. If a landing call is free, then there are no limitations, but if it has been reserved, then the range of values for the gene is limited to one and the only value it can get is the elevator car reserved for it. The allocation decision is taken to the call fixation control unit, which reserves and controls the signaling.

An additional feature is the method is its flexibility for implementing a floating signaling time, regarding which there are two principles of approach. Passengers can be informed of the elevator to serve them when a certain length of time will elapse before the arrival of the elevator. On the other hand, passengers can be given an indication of the elevator to serve them within a certain time after the landing call was entered, in which case it will be possible for a person having pressed a landing call button to move to a better position to wait for a while and, when the signaling appears, walk back to the area in front of the elevator to be ready to enter. This approach may be easier for passengers to adopt. Thus, in addition to pure immediate allocation of landing calls, the method also contains a possibility for more flexible implementations. The above-described control method is suited e.g. for buildings where early signaling is required and, on the other hand, where the conception of the service standard of the elevators tends to be associated with the overall service received, e.g. in hotels. In this case, it will be an advantage if passengers can move with their luggage in time and without great haste to the area in front of the elevator to serve them. A corresponding need for early signaling is also encountered in large elevator systems, in which the walking distances to different elevators may be long.

In the following, the invention will be described in detail by the aid of some of its embodiments with reference to the drawings, wherein FIG. 1 presents the overall architecture of the method, showing an allocation unit, a call fixation control unit and the signaling devices provided on different floors.

Figure 2:
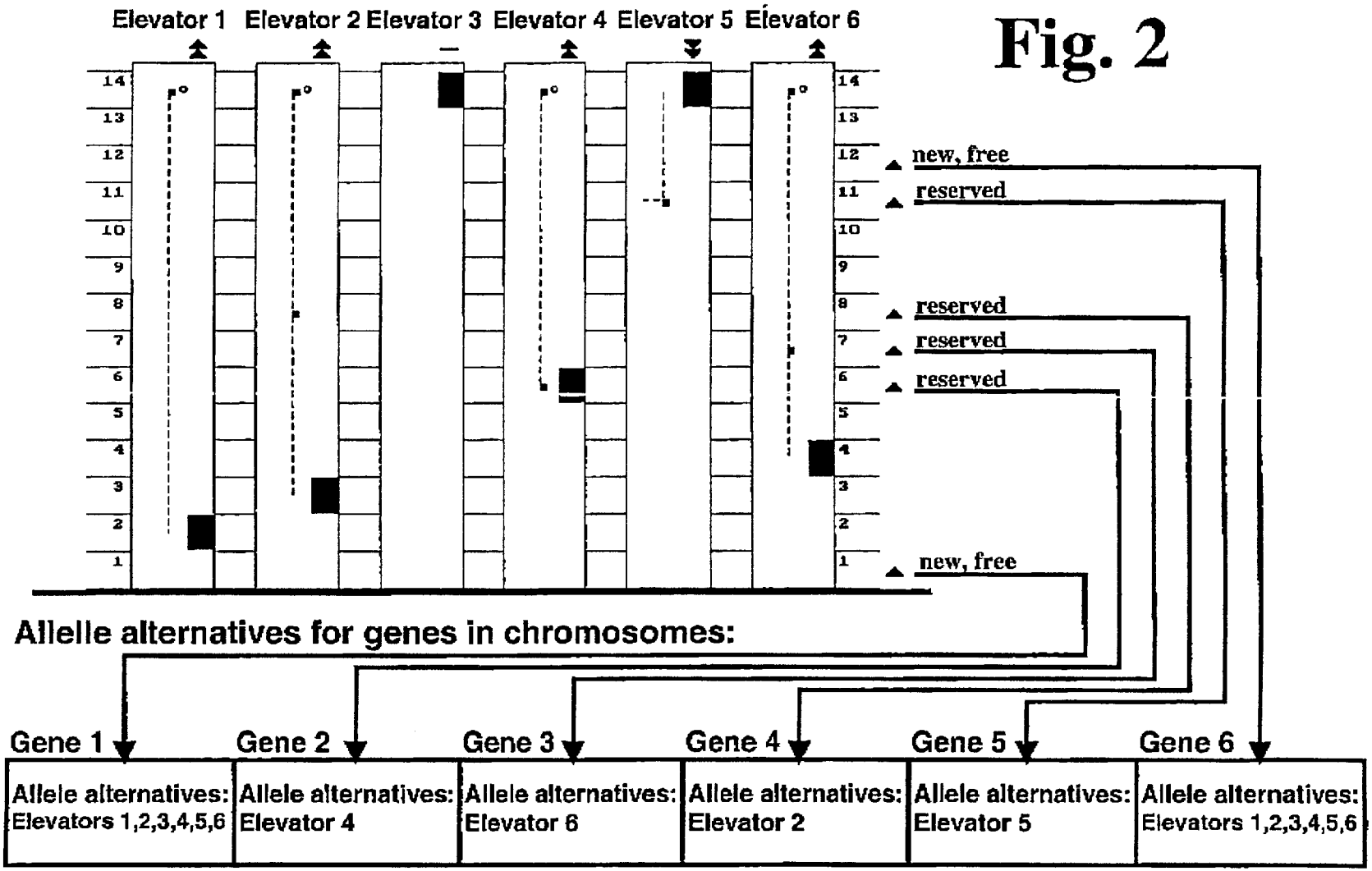

FIG. 2 illustrates a case where six active landing calls are coded to form a chromosome in an elevator group comprising six elevators and fourteen floors.

As illustrated in FIG. 1, a control decision is made in an allocation unit, where optimal routes for serving landing calls are formed for the elevator cars in the elevator group. To the left of the allocation unit, the figure shows fundamental data used as a basis for the allocation decision. Such data includes traffic statistics, data indicating active landing calls, and status data for the elevator group, e.g. position and traveling direction of the elevator cars, car loads and car calls. In addition to these data, the allocation unit also takes into account any landing call-specific service limitations concerning the elevator cars, depicted above the allocation unit in the figure. Before the process of making a control decision by searching for optimal routes for the elevator cars is started, the required data are initialized and possible service limitations are taken into account. Once the control decision has been made, optimal routes for serving the landing calls are formed for the elevator cars. The allocation decisions are executed in accordance with the optimal routes of the elevator cars. In addition to this, the optimal routes are taken to the call fixation control unit, where elevator cars are reserved for free active landing calls and signaling commands are sent to the signaling devices on the floors of origin of the landing calls. In the figure, the call fixation control unit and the signaling devices on different floors are shown above the allocation unit. If call fixation is implemented in a flexible manner, then the time of arrival of the elevator car at the floor of the landing call to be served is compared with a signaling advance time in the call fixation control unit, on the basis of which the landing call is either fixed for an elevator car or left free for allocation. If the time of arrival of the elevator car according to the allocation decision remains below the signaling advance time set for the floor to be served by the car, then the elevator car will be reserved for the landing call. Thus, in practice, the fixation sets service limitations for active landing calls because it will not be possible for the other elevator cars in the elevator group to serve a fixed landing call. This piece of information is utilized in the allocation unit during the next rounds of allocation, where each landing call fixed for an elevator car can only be served by the elevator car previously assigned for it.

In FIG. 2, the valid active landing calls, all of which are up calls, are indicated on the right-hand side of the elevator group. Each landing call corresponds to a gene, whose value refers to the elevator car which is to serve the call. The genes of the chromosome together with their possible values, i.e. alleles, are depicted in the lower part of the figure. The valid active landing calls are at floors 1, 6, 7, 8, 11 and 12, and accordingly the number of landing call genes in the chromosome will be six. Let us consider the situation of the elevator group illustrated by this figure a little closer before the landing calls are coded into final genes. For elevator 1, there is no landing call allocated to it, so it will only serve the call it currently has, a car call to floor 14. Elevator 2 will serve a landing call at floor 8 and a car call to floor 14. Elevator 3 is standing idle at floor 14. Elevator 4 is to serve a landing call at floor 6 and a car call to the top floor. Elevator 5 again is leaving floor 14 in order to serve a landing call at floor 11. Elevator 6 is to serve a landing call at floor 7 and continue to the destination of its car call. For each floor to be served by an elevator, an estimated ETA time can be computed in accordance with the route of each elevator, although these times are not shown in the figure.

There are two types of landing call: free and reserved. The free landing calls, which have just appeared, have been issued from floors 1 and 12. Since these calls have not yet been allocated to any one of the elevator cars, there are no service limitations set by the control unit, so any one of the available elevators may serve these calls. Therefore, the possible alleles of these genes are elevators 1–6, in other words, the number of alternative elevators for both of these landing calls is six. On the other hand, there are also active landing calls in the system, each of which has already been allocated to one of the elevators and signaled at the appropriate floors. These landing calls reserved by the call fixation control unit are at floors 6, 7, 8 and 11. At the beginning of the allocation procedure, the range of values of these four landing call genes is limited to one possible alternative, which is the elevator car previously allocated for the call. According to the example figure, the only alternative for gene number 2, i.e. for the landing call of floor 6, is elevator 4. Similarly, each one of the other reserved landing calls already allocated is assigned to one elevator: the landing call at floor 7 to elevator 6, the landing call at floor 8 to elevator 2, and the call at floor 11 to elevator 5. As the ranges of values of each landing call gene as well as the respective elevators are known, allocation can be started. In the present case, allocation is only performed in order to find an optimal elevator car for the landing calls at floors 1 and 12. However, all landing calls are included in the evaluation of alternative solutions in order to allow optimal routes to be established for each elevator in accordance with the principles of genetic allocation. Once an allocation decision has been reached, the routes of the elevators are input into the call fixation control unit, which will fix the landing calls at floors 1 and 12 for the elevators determined by the allocation procedure and update the ETA times for the calls.

In pure immediate allocation, the landing calls at floors 1 and 12 are allocated immediately to the elevators assigned for them. In the more flexible system of the invention, the point of time of fixation of a landing call can be set by a parameter. According to the parameter, the instant of fixation of the landing call is e.g. 30 seconds. If the allocation procedure suggests for this call an elevator whose estimated time of arrival with respect to the landing call is less or the same as the parameter value of 30 seconds, then the call fixation control unit will reserve the landing call for the suggested elevator and send a signaling command. On the other hand, if the ETA time exceeds 30 s., then the call fixation control unit will not yet reserve the elevator for the landing call but keep it freely allocable. Let us assume that the allocation procedure suggests that the landing call at floor 1 be served by elevator 3, which will arrive at the call floor later than in 30 seconds, and that the landing call at floor 12 be served by elevator 5, which will arrive at the call floor in less than 30 seconds. In this case, the call fixation control unit will reserve the landing call at floor 12 for elevator 5 and leave the landing call at floor 1 free. When a new round of allocation is started, the landing call at floor 12 is limited to be served by elevator 5, whereas all elevators have a chance to serve the free landing call at floor 1 as the range of values of the gene for this call still includes elevators 1–6. The range of values of the gene for the landing call at floor 12 has been reduced to one, elevator 5. When later an elevator with an ETA time below 30 seconds is suggested for the landing call at floor 1, the call fixation control unit will be able to reserve this call, too.

In the following, an alternative approach to more flexible signaling will be described. A landing call for an elevator car is fixed for the landing call when it has been active for a given length of time indicated by a parameter. For example, if the parameter has been set to 10 seconds, then an elevator is fixed and signaled after ten seconds upon the entry of the landing call. In the call fixation control unit, the active time of the landing call after allocation is compared with the parameter, so the system will know which elevator is going to serve each call. All landing calls whose active time is less than the parameter time are kept free for allocation. When the time is exceeded, the elevator car suggested for the landing call is fixed, which means that in the next round of allocation it will be the only alternative for the landing call in question. Other landing calls still remain free for allocation. However, there is one special case to be taken into account; the allocation procedure may suggest for the landing call an elevator that will arrive at the floor of issue of the landing call before the active time of the landing call does not exceed the parameter time. In this case, the landing call will still be fixed and signaled in the normal manner even if the active time of the landing call should be less than the parameter value.

The invention is not restricted to the examples of its embodiments described above; instead, many variations are possible within the scope of the inventive idea defined in the claims.

What is claimed is:

1. Method for allocating calls entered via the landing call devices of elevators belonging to an elevator group using a genetic allocation procedure, characterized in that the service routes for the elevator cars are established via a search performed by the genetic allocation procedure, which decides which elevator is to serve which landing call, a call fixation control unit takes care of the reservation and release of landing calls and the control of signaling, the service routes thus established for the elevator cars are input into the call fixation control unit, which registers each landing call as being reserved for the elevator car suggested for it, in the case of a reserved landing call, the call fixation control unit determines an elevator car which is allowed to serve the call, in the case of a free landing call, all elevator cars can potentially be used to serve the call, in the case of a reserved landing call, only the assigned elevator car is ready to serve the call, the call fixation control unit decides which landing call is free and which is reserved, the call fixation control unit reserves the landing call for the elevator car to whose service route it was allocated by a landing call allocation unit during a first round of allocation, the call fixation control unit limits the alternative elevator cars of the gene corresponding to the call in the genetic allocation unit to one alternative, which is the elevator car previously allocated for the landing call.

2. Method as defined in claim 1, characterized in that fixation of the call is performed when the time of arrival of the elevator car at the landing call to be served is less than a preset limit value.

3. Method as defined in claim 1–2, characterized in that fixation of the landing call is performed when a preset length of time has elapsed since the landing call was entered.

4. Method as defined in claim 3, characterized in that the preset time is varied according to traffic intensity, time of the day, date or a preliminary plan.

5. Method as defined in claim 1–2, characterized in that there are simultaneously at least one floor to be signaled according to the service routes of the elevators.

* * * * *